United States Patent [19]

Chang

[11] Patent Number: 4,918,838

[45] Date of Patent: Apr. 24, 1990

[54] SHOE SOLE HAVING COMPRESSIBLE SHOCK ABSORBERS

[75] Inventor: David J. H. Chang, Taichung, Taiwan

[73] Assignee: Far East Athletics Ltd., Taipei, Taiwan

[21] Appl. No.: 228,458

[22] Filed: Aug. 5, 1988

[51] Int. Cl.[5] ..... A43B 13/20; A43B 21/26

[52] U.S. Cl. ..... 36/28; 36/29

[58] Field of Search ..... 36/28, 29, 35 R, 35 B, 36/36 R, 37, 102

[56] References Cited

U.S. PATENT DOCUMENTS

| | | | |
|---|---|---|---|
| 4,229,889 | 10/1980 | Petrosky | 36/28 |
| 4,577,417 | 3/1986 | Cole | 36/28 X |
| 4,680,876 | 7/1987 | Peng | 36/35 R X |
| 4,768,295 | 9/1988 | Ito | 36/29 X |
| 4,779,359 | 10/1988 | Famolare | 36/28 |

*Primary Examiner*—Donald Watkins

*Attorney, Agent, or Firm*—Cushman, Darby & Cushman

[57] ABSTRACT

This is a sole with compressible shock absorbers which not only provides an improved shock absorbing function but also provides more comfort for the wearer. The shock absorbers consist of a polygonal replaceable air bellows placed in a polygonal recess on the forefoot section of the shoe and a cylindrical replaceable air cylinder placed in a circular recess on the heel section of the shoe. The air cylinder and air bellows are made of an integrally resilient air-tight material such that, during exercise, the shock absorbers absorb and then return the energy in a controlled upward direction, by way of the bellows-type body and the friction caused between the inside wall of the recess and the bellows itself. Moreover, since the shock absorbers can be placed easily by hand, the wearer can adjust the shoes in line with his weight and type of sport performed. The uses of the shoe are therefore maximized because the air cylinder and air bellows will continue to function even after the outer sole has experienced considerable wear and tear.

12 Claims, 6 Drawing Sheets

SHOE SOLE HAVING COMPRESSIBLE SHOCK ABSORBERS

The present invention relates to a sole with compressible shock absorbers and, in particular, to replaceable air cylinders and bellows installed respectively in the heel and forefoot of the shoe. These compressible air cylinders and bellows provide complete shock absorbtion for the foot.

In our daily life, our shoes are the instruments that bear the weight of our body and are constantly subjected to the impact of that weight throughout the day. Our shoes are, therefore, the most important medium through which the external force acts on the body.

Through research we have discovered that the impact force exerted on the soles of the shoes of an ordinary man during running is three to four times greater than that during walking. This is because of the combination of gravity together with the effects of body weight at running speed. Moreover, the impact is concentrated on the heel and forefoot portions of the foot, one foot at a time only. This quickly results in tiredness, muscular pain and possibly in serious injury. In view of this, it is essential that the structural design of the shoe must not only provide comfort for the wearer but must also reduce the heavy impact of the external force acting again the sole of the shoe.

The primary intention of this invention is to overcome the disadvantages mentioned above by providing replaceable air cylinders and bellows which are inserted into purposely dimensioned recesses both in the forefoot and heel area of the shoe's midsole. In this way, the wearer, when exercising, it relieved of the strong external impact on the bottom of the foot.

Furthermore, by using air cylinders constructed out of a resilient, totally air-tight material whereby the air sealed within has been precisely controlled by means of specially designed equipment, one can ensure that the desired shock absorbing effect can be permanently maintained. Under normal conditions, the air pressure within the cylinders is between 3–5 psi. However, for those with a heavier body or for particularly strenuous exercises, the internal air pressure can be increased to between 6–8 psi. The air cylinders will continue to provide shock absorbtion and protection from injury, even after the outsoles of the shoes have been subjected to considerable wear-and-tear.

The invention works in the following way: the cylindrical replaceable air cylinder is bedded into the heel portion of the foot. The upper end forms a lip over the precisely dimensioned recess, once in place, such that the cylinder will remain in proper contact with the heel of the foot regardless whether or not the sole is on the ground. The flange acts also to prevent the cylinder from collapsing down into the upper surface of the sole unit.

The air cylinder in place, it now undergoes two stages of compression once subjected to the pressure resulting from the wearer's exercise. The first stage allows the top surface of the cylinder to be flattened down onto the level of the sole itself. Part of the shock is absorbed at this stage. The remainder of the resultant shock is transmitted down towards the base of the cylinder via the bellows, the side walls of the cylinder itself. The shock absorbtion is thus gradual and controlled. The same effect is experienced at the forefoot where the air bellows performs the same function.

A further benefit of this invention is that the air cylinder and air bellows are made of an integrally resilient material such as polyvinyl chloride or polyurethane or rubber. Since the replaceable one-piece cylinder can simply be placed manually into the recess in the shoe's sole, no further production processes are required for final shoe manufacture. In this case, production is both efficient and cheap and servicing is practicable.

A special feature worthy of mentioning is that the air cylinder and air bellows are quite different from the inflatable air cushion or air-bag sole presently prevailing in the market place. The major difference is that the air cylinder and air bellows absorb shock and impact and then return the energy only through the two uppermost points of the cylinders' arcs. Foot stability is not affected because the horse-shoe shaped section of EVA (FIG. 1A), in which the cylinder and bellows are encased, provides a much large area of stability.

However, in the case of the air cushion or air-bag there is a much larger area through which the shock is absorbed, and, by extension, the surrounding area of EVA is much smaller and thus giving no extra element of stability. As a result, the foot will move from side to side within the shoe itself leading not only to instability but also, and more seriously, to injuries.

Finally, since the simplicity of this invention allows one to position and remove the air cylinder manually, the user may select, according to his weight and type of sport, a replacement air cylinder with a greater density (ie. 6–8 psi).

BRIEF DESCRIPTION OF THE DIAGRAMS

The following description of the air cylinder and air bellows concept should be read in line with the attached diagrams, as follows:

FIG. 1 Perspective view of the various components of the aforesaid invention;

Figure 3:
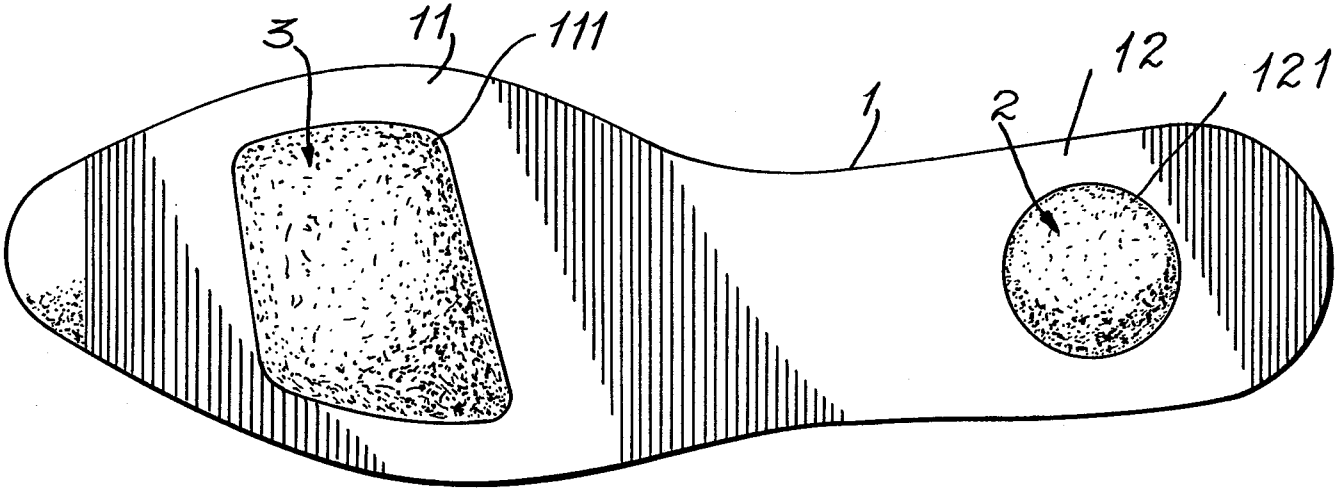
Figure 5A:
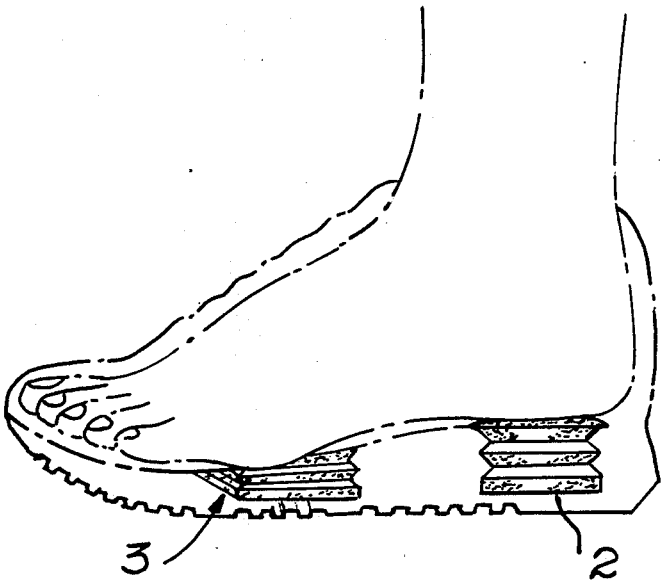
Figure 5B:
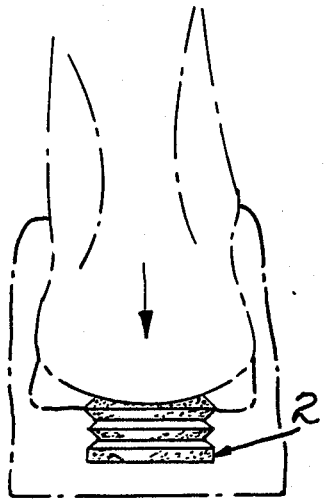
Figure 4B:
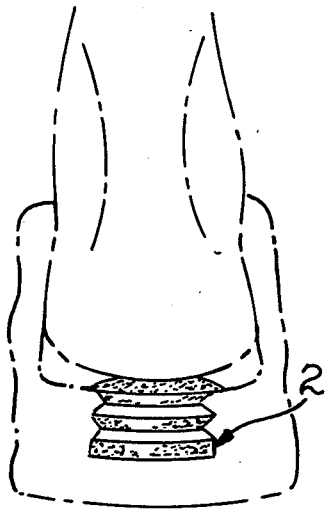
Figure 4A:
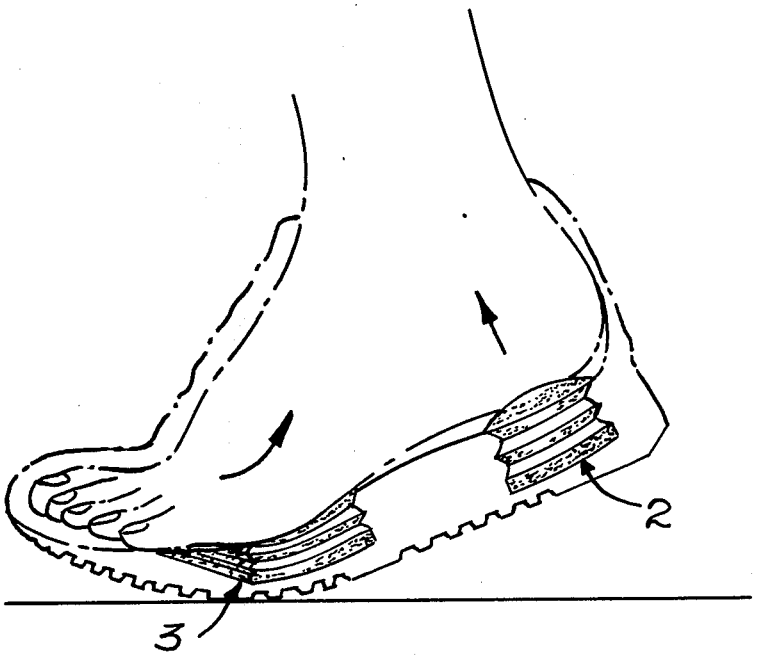
Figure 6A:
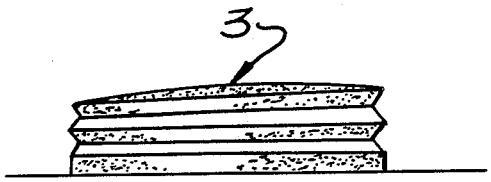
Figure 6B:
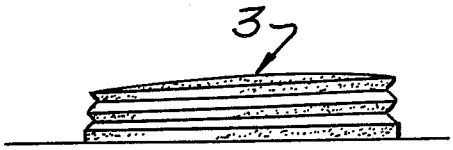
Figure 6C:
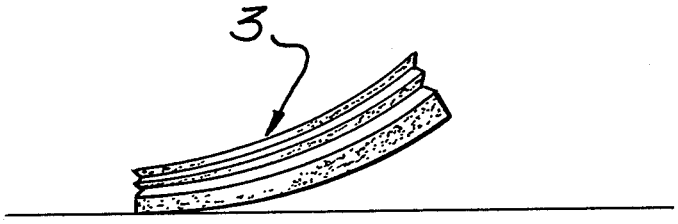

FIG. 3 Top elevation view demonstrating placement of shock absorbers in the sole-unit itself;

FIG. 4A Shows the changes experienced during movement by the air bellows at forefoot section of the shoe;

FIG. 4B Shows the changes experienced during movement by the air cylinder at the heel of the shoe;

FIG. 5A Shows the changes experienced during jumping by the air bellows at the forefoot section of the shoe;

FIG. 5B Shows the changes experienced during jumping by the air cylinder at the heel of the shoe;

FIG. 6 Shows the air bellows of the afore-said invention in:

A. normal condition
B. during rapid vertical impact (i.e. jumping)
C. during impact, air bellows forms an arc to accomodate metatarsal bones.

DETAILED DESCRIPTION OF THE INVENTION

Figure 1:
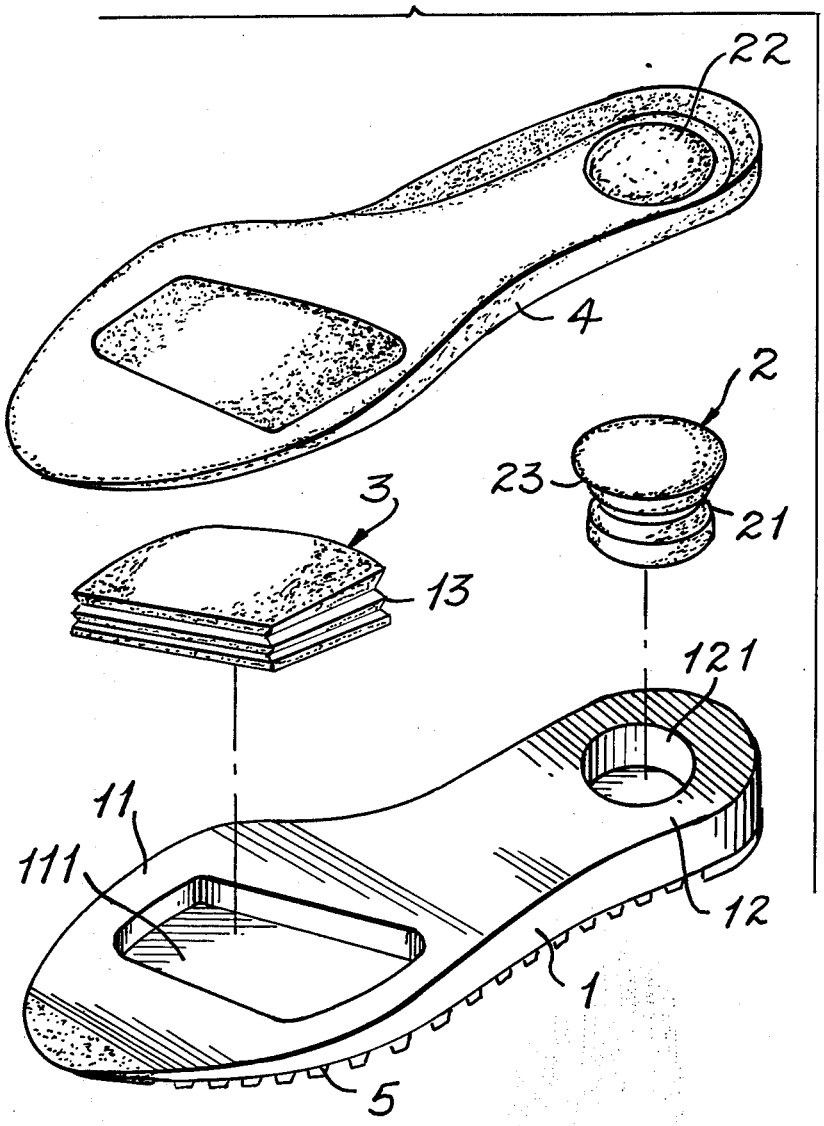
FIG. 1A Shows the horseshoe type stabilizer made of a more dense material surrounding the air cylinder at the heel section of the shoe.
Figure 1A:
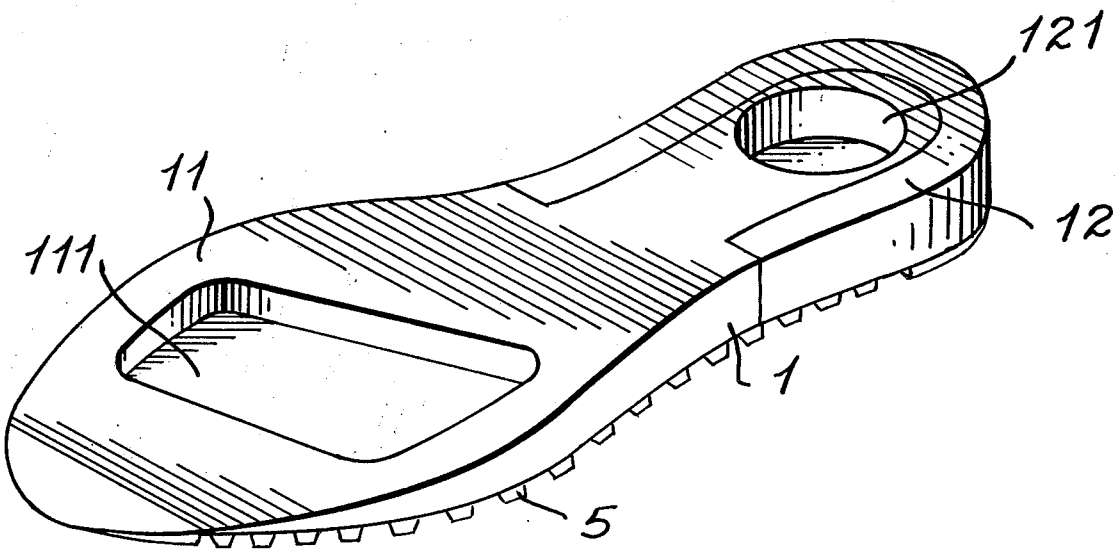
Figure 2:
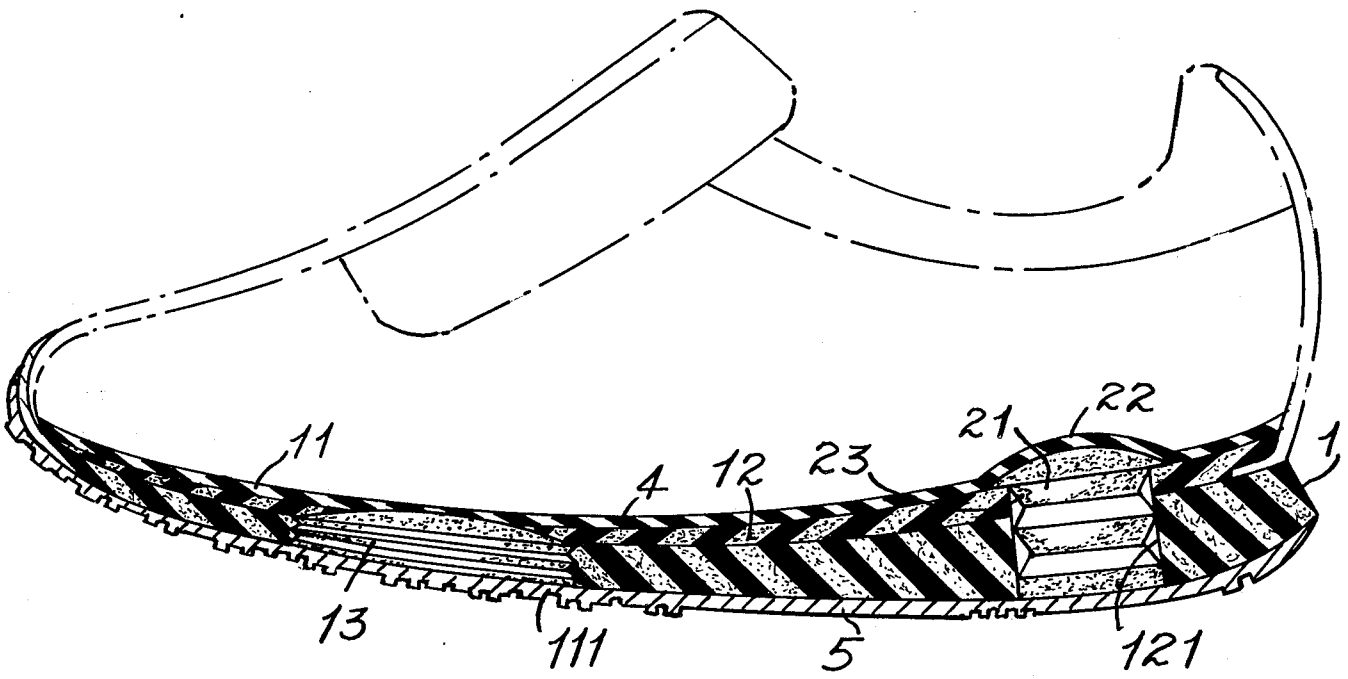
FIG. 2 is cross-section of the sole and the correct placement of the shock absorber.

In reference to FIGS. 1 and 2, the cylindrical body (item No. 21) of the replaceable air cylinder is placed into the circular recess (item No. 121) in the heel portion of the sole unit (item No. 1). The bellows like body (item No. 13) of the replaceable air bellows (item No. 3)

is placed into a square-shaped recess (item No. 111) in the forefoot section of the sole unit (item No. 11). The bottom ends of the air cylinder and air bellows are both smooth planar surfaces such that they come into line with the upper surface of the outer sole (item No. 5) by way of simple manual insertion. A removable innersole pad (item No. 4) is made of ethylene-vinyl acetate polymer or polyurethane and is provided with a dome (item No. 22) at the heel area and with a quadrilateral profile at the forefoot area. The bottom surface of the dome is shaped to cover the uppermost surface arc of the air cylinder (item No. 2) and the bottom surface of the forefoot of the innersole pad (item No. 4) is shaped to cover the uppermost surface of the air bellows (item No. 3). During assembly, therefore, the innersole pad fits perfectly over the configuration of the air cylinder and bellows respectively, ensuring maximum comfort for the wearer.

In reference to FIG. 4A, the diagram shows how the air bellows changes shape to protect the metatarsal bones when the sole of the shoe hits the ground. Moreover, during running, the configuration of the air bellows changes in proportion to the magnitude of the impact force applied to the sole. In this way, the effects of shock absorbtion, energy return and comfort are achieved.

FIG. 4B shows the configuration of the air cylinder (item No. 2) at the heel of the foot before being subjected to the impact force.

FIG. 5B shows the changes in the configuration of the compressed air cylinder (item No. 2) when the heel is subjected to a strong impact force. In such cases, it is precisely the heel that transmits the force through to the air cylinder from the top surface to the bottom of the sole such that the force is broken down into 2 stages achieving the dual effects of energy return and shock absorbtion.

A flange (item No. 23) is formed at the point where the side walls of the air cylinder meet the surface arc. Once in place, the air cylinder undergoes two stages of compression. The first half of the shock is absorbed when, on being subjected to the initial pressure, the top surface of the cylinder is flattened down onto the level of the sole itself (item No. 1). The remainder of the shock is transmitted down towards the base of the cylinder via the side walls (ie. bellow) of the air cylinder. Since the air cylinder contracts downwards within the recess (and since the cylinder itself is totally air-tight), the impact is returned to the foot and transform a kind of energy in direct relation to the impact exerted. The harder the impact, the more the energy is returned. Both the recess (item No. 121) and the bellow-like body of the air cylinder (item No. 21) control the direction of the impact force and, in turn, cause the energy inside the air cylinder to move at once downwards and then immediately upwards, such as a piston in an engine. Moreover, the friction created between the inside of the recess and the walls of the bellows-like body produces heat and causes the air inside the cylinder to expand. In this way, the air cylinder becomes more rigid and tends to be more resilient even after a long run.

The effects of energy return and shock control not only enable the wearer to conserve energy but also serve to reduce the possibility of injury. Marathon runners can run longer and faster, basketball players can jump higher.

FIG. 6 shows the physical state of a polygonal replaceable air bellows placed in the forefoot portion of the shoe during exercise and the resultant response in terms of shock absorbtion. Comfort is ensured because the curve of the shock absorber alters in line with the shape of the wearer's foot, regardless of his weight or type of sport.

I claim:

1. A shoe sole unit with compressible shock absorbers comprising:

shock absorbers which comprise a replaceable generally cylindrically-shaped air cylinder installed at the heel, and a replaceable polygonal-shaped air bellows at the forefoot portion respectively;

a sole unit which provides on the forefoot and the heel portion a suitable recess for receiving each of said replaceable shock absorbers; and a removable innersole pad disposed above said sole unit and said replaceable shock absorbers thereby obtaining a shock absorbing shoe sole unit with that also provides energy return, and motion control.

2. A shoe sole according to claim 1 wherein said air bellows is shaped so as to have a pre-determined number of folds in the vertical direction with which said air bellows is capable of contracting steadily when subject to an impact force.

3. A shoe sole unit according to claim 1 wherein said replaceable air cylinder comprises an uppermost arced surface and a cylindrical body located thereunder, said cylindrical body having a pre-determined number of bellows like folds in the vertical direction, whereby, upon the application of an impact force, first, said uppermost arced surface is pressed inwardly and second, said cylindrical body contracts steadily in the vertical direction.

4. A shoe sole unit according to claim 3 wherein said replaceable air cylinder has a flange at the intersection of said uppermost surface arc and said cylindrical body such that said flange is in exact engagement with the surface of said sole unit and is adjacent to the recess.

5. The shoe sole according to claim 1 wherein said recess on the forefoot portion of said shoe sole is of shape and size identical to those of said polygonal replaceable air bellows such that said polygonal replaceable air bellows can be received in said recess; and said recess on the heel portion of said shoe sole is of shape and size identical to those of said cylindrical replaceable air cylinder such that said cylindrical replaceable air cylinder can be received in said recess on the heel portion.

6. A shoe sole unit comprising:

shock absorbers including a replaceable cylindrically-shaped air cylinder installed at the heel portion thereof, and a replaceable polygonal air bellows installed at the forefoot portion thereof, respectively;

a sole unit structurally arranged to provide on its forefoot and heel portions thereof a recess for receiving each of said replaceable shock absorbers; and a removable innersole pad disposed above said sole unit and said replaceable shock absorbers.

7. A shoe sole unit comprising:

shock absorbers including a replaceable air cylinder installed at the heel portion thereof, and a replaceable air bellows installed at the forefoot portion thereof, respectively, said replaceable air bellows having the same thickness as the forefoot portion of said shoe sole and said replaceable air cylinder being the same height as the heel portion of said shoe sole;

a sole unit structurally arranged to provide on its forefoot and heel portions a suitable recess for receiving each of said replaceable shock absorbers; and a removable innersole pad disposed above said sole unit and said replaceable shock absorbers.

8. A shoe sole unit comprising:

shock absorbers including a replaceable air cylinder installed at the heel portion thereof, and a replaceable air bellows installed at the forefoot portion thereof, respectively;

a sole unit structurally arranged to provide on the forefoot and heel portions thereof a suitable recess for receiving each of said replaceable shock absorbers; and a removable innersole pad disposed above said sole unit and said replaceable shock absorbers, said removable innersole having an inward, concave, bottom surface profile at the forefoot and heel portions thereof respectfully.

9. A shoe sole unit according to claim 8 wherein said inward, concave, bottom surface profile above said forefoot portion is arranged so as to mate with the top surface of said replaceable air bellows.

10. A shoe sole unit according to claim 8 wherein said inward, concave, bottom surface profile above said heel portion is arranged so as to mate with the top surface of said uppermost surface arc of said replaceable air cylinder.

11. The shoe sole according to claim 8 wherein said removable innersole pad is made integrally of polyurethane.

12. The shoe sole according to claim 8 wherein said removable innersole pad is made integrally of ethylene-vinyl acetate polymer.

* * * * *